US011434692B2

(12) United States Patent
Lombardini

(10) Patent No.: US 11,434,692 B2
(45) **Date of Patent: *Sep. 6, 2022**

(54) CUSHION FOR SHADING SYSTEM

(71) Applicant: PLASTEX SA, Madonna del Piano (CH)

(72) Inventor: Marco Lombardini, Vernate (CH)

(73) Assignee: PLASTEX SA, Madonna del Piano (CH)

( * ) Notice: Subject to any disclaimer, the term of this patent is extended or adjusted under 35 U.S.C. 154(b) by 668 days.

This patent is subject to a terminal disclaimer.

(21) Appl. No.: 15/916,544

(22) Filed: Mar. 9, 2018

(65) Prior Publication Data

US 2018/0195343 A1 Jul. 12, 2018

Related U.S. Application Data

(63) Continuation-in-part of application No. 15/389,678, filed on Dec. 23, 2016, now abandoned, which is a (Continued)

(30) Foreign Application Priority Data

Jun. 5, 2012 (CH) ..... 00776/12

(51) Int. Cl.
*E06B 9/58* (2006.01)
*E06B 9/38* (2006.01)
(Continued)

(52) U.S. Cl.
CPC ..... *E06B 9/582* (2013.01); *E06B 9/38* (2013.01); *E06B 9/13* (2013.01); *E06B 9/40* (2013.01)

(58) Field of Classification Search
CPC . E06B 9/58; E06B 9/582; E06B 9/581; E06B 9/588; E06B 7/16; E06B 7/20; E06B 7/23; E06B 7/22; E06B 7/2312
See application file for complete search history.

(56) References Cited

U.S. PATENT DOCUMENTS 4,527,807 A * 7/1985 Urbanick ..... E06B 7/2312 277/642
4,610,293 A 9/1986 Weiblen
(Continued)

FOREIGN PATENT DOCUMENTS

DE 8802780 U1 6/1988
DE 9406851 U1 6/1994
(Continued)

OTHER PUBLICATIONS

International Search Report for International Application No. PCT/IB2013/054436 dated Oct. 7, 2013.
(Continued)

*Primary Examiner* — Daniel P Cahn
*Assistant Examiner* — Jeremy C Ramsey
(74) *Attorney, Agent, or Firm* — Dorsey & Whitney LLP

(57) ABSTRACT

The invention describes a cushion for shading system of the type comprising a piece of cloth slidingly fastened to a section bar of an upright. A raceway with a substantially C-shaped cross section serves to fasten the cushion to a section bar edge, and a flexible tongue, having an end on the raceway and an opposed end spaced therefrom in order to contact the upright, serves as a spring between the section bar and the upright, allowing the section bar to come nearer to the upright in a compression phase or to be spaced in a predetermined way in the absence of compression.

25 Claims, 13 Drawing Sheets

Related U.S. Application Data continuation of application No. 14/405,630, filed as application No. PCT/IB2013/054436 on May 29, 2013, now Pat. No. 9,556,669.

(51) Int. Cl.
*E06B 9/40* (2006.01)
*E06B 9/13* (2006.01)

(56) References Cited

U.S. PATENT DOCUMENTS

| | | | | |
|---|---|---|---|---|
| 5,479,979 | A | 1/1996 | Hayashiguchi et al. | |
| 5,716,155 | A | 2/1998 | Tuge et al. | |
| 6,305,125 | B1 * | 10/2001 | Nozaki | B60J 1/17 49/415 |
| 7,793,702 | B2 * | 9/2010 | Biewer | B60J 7/0007 160/370.22 |
| 8,602,081 | B2 | 12/2013 | Adachi et al. | |
| 8,607,841 | B2 | 12/2013 | Hayashiguchi et al. | |
| 2014/0076507 | A1 | 3/2014 | Dibben et al. | |

FOREIGN PATENT DOCUMENTS

| | | | |
|---|---|---|---|
| DE | 202009002343 | U1 | 7/2010 |
| FR | 2430512 | A1 | 2/1980 |
| GB | 2502039 | A | 11/2013 |
| JP | H0780570 | | 3/1995 |
| JP | 2004211298 | A | 7/2004 |
| JP | 2004211299 | A | 7/2004 |
| WO | 2012050518 | A1 | 4/2012 |

OTHER PUBLICATIONS

U.S. Appl. No. 14/405,630, filed Dec. 4, 2014.
U.S. Appl. No. 15/389,678, filed Dec. 23, 2016.

* cited by examiner

CUSHION FOR SHADING SYSTEM

FIELD OF APPLICATION

The present invention relates to a cushion for shading system of the type comprising a piece of cloth sliding in a pair of uprights, associated to or incorporated in the frame of a window to be shaded; the cushion is inserted in the uprights, in order to deaden the wind effect which tends to move sharply the piece of cloth between the uprights. The invention also relates to a cushion system comprising the above-mentioned cushion and to a section bar whereto the cushion is fastened. The invention also relates to a particularly advantageous upright section bar, whereon the cushion is to be assembled.

PRIOR ART

It is known that a shading system comprises a piece of cloth suitable to shade an opening, for example a piece of cloth made of plastic material or fabric, connected to a cord or rod in order to be withdrawn from the opening, allowing the light to get through, or lying along it, for shading. The shading system opening and closing is for example a rolling gate, in which case the piece of cloth is sliding in a pair of guide uprights, associated to a frame or incorporated therein.

In general, guide uprights are perpendicular to the floor and the piece of cloth appears vertically sliding; there is nothing to prevent the uprights from being horizontal and the piece of cloth horizontally sliding. More particularly, opposed sides of the piece of cloth are inserted in section bars, preferably plastic ones and known per se, which form the piece of cloth guide in the upright. Substantially, the section bar has the same length as the upright and it is retained in a thickness of the upright with a predetermined play, which favours the horizontal movement of the piece of cloth.

Known shading systems are quite noisy, especially when they are lying, due to the fact that the piece of cloth can be knocked down by air draughts which tend to move it sharply between the uprights, causing the section bars to bang against them. What has been said above appears evident from FIGS. 1 and 1*a*, related to a detail of a section bar A (FIG. 1) and to a front cross section thereof (FIG. 1*a*). The section bar A, as said above, is fastened in the upright of a window frame and it comprises a seat S for an edge or side of the piece of cloth; during the assembly, the piece of cloth edge appears slidingly insertable in the seat S through an opening E of the section bar, letting the rest of the piece of cloth coming out of the seat S (and of the upright) through a fissure B of the section bar, which has a width being lower than the piece of cloth edge, in order to retain the edge in the seat S. The opposed edge of the piece of cloth is similarly associated to a section bar of the other frame upright. When the air acts on the piece of cloth surface, the piece of cloth moves the section bar which, as said above, is coupled to the upright with a predetermined play, causing it to bang against it.

On the other side, keeping the piece of cloth in tension between the uprights, for example by rigidly fastening the section bar to the uprights, without leaving any movement margin to the section bar in the uprights, in the attempt to prevent the piece of cloth from waving under the action of the wind, is not an effective solution, since in the long run the wind damages the piece of cloth or it loosens anyway the coupling thereof with the section bar, and it spoils the shading system.

Cushion systems are also known, which comprise a little sponge C or a plurality of little sponges stuck along the section bar, in order to cushion the impact of the section bar against the upright.

However, in these shading systems too it is necessary to leave some movement margin to the section bar in the upright, which prevents an optimal tension of the piece of cloth, also in the absence of wind. Moreover the little sponges are wearing, which causes the detaching thereof from the section bar or the loss of effectiveness in deadening the stroke against the upright. Moreover, the application thereof is quite difficult, especially when carried out by hand.

The technical problem underlying the present invention is to think up a cushion for shading system which is very simple to realize and simple to apply to the section bar, also mechanically, which is capable to effectively reduce the noise caused by the section bar movement in the upright, avoiding the piece of cloth to be damaged due to the opening, closing and adjusting operations of the shading system or to the action of the wind, but also allowing an optimal tension of the piece of cloth, both in wind condition, and in the absence thereof, being finally cheap, and overcoming the limits and drawbacks still affecting known shading systems.

SUMMARY OF THE INVENTION

The idea underlying the present invention is to apply on the section bar of a shading system a cushion which prevents the direct contact between the section bar and a respective upright, the cushion comprises a tongue with an end turned towards the upright, preferably always in contact therewith, and an opposed which is applicable or applied to the section bar.

More particularly, a cushion for a shading system according to the present invention is a cushion of the a type including a piece of cloth slidingly fastenable to a section bar of an upright, and comprising:

a flexible tongue having an end adapt to be attached to the section bar and an opposed end adapt to be spaced therefrom to contact the upright and to serve as a spring between the section bar and the upright, allowing the section bar to come nearer to the upright in a compression phase or to be spaced in a predetermined measure in an absence of compression.

Preferably, the flexible tongue has a predetermined width and a predetermined thickness which are constant along the length of the flexible tongue. For instance, the length of the flexible tongue is from 2 to 4 cm and the width is from 0.5 to 1.5 cm. as apparent in the following disclosure, the flexible tongue may have different shape at rest.

In an aspect of the present invention, the flexible tongue is directly attached to the section bar.

In one embodiment according to this aspect of the present invention, one end of the flexible tongue is adapted to be attached to the section bar and includes a surface, preferably flat, adapted to be glued on a corresponding coupling surface, preferably flat, of the section bar. Nothing prevents that the surface to be glued has a different shape, for instance is curved, and the section bar includes a recess o same curvature to receive the glue and the surface of the flexible tongue to be glued.

In another embodiment still related to this aspect of the present invention, the end of the flexible tongue is attached to the section bar through male/female coupling means.

Preferably, the male/female coupling means includes a male element on the end of the flexible tongue and a female element on the section bar. For instance, the male element is a pin protruding from a flat portion at the end of the flexible tongue, the pin including a head with a cross section and an annular portion with a section smaller than the section of the head. The annular portion is between the head and a base portion of the pin. The female element of the section bar includes a hole of a section corresponding to the section of the annular portion, adapted to retain the pin when the head is passed through the hole. Preferably, the flexible tongue is removable from the section bar. The section bar includes a plurality of female elements, for instance at a predetermined pitch one form the other. A plurality of flexible tongues may be attached to the section bar, engaging all the female elements or only part of them, depending of the cushioning strength to be obtained.

Preferably, the flexible tongue is plastic, more preferably polypropylene. The applicant has realized that using a transparent plastic which is also UV light resistant has great advantages since the cushioning property is not affected by sun rays, also after long period of exposure. Therefore the cushion has longer durability. Moreover, it is aesthetically appreciated.

According to another embodiment of the invention, the flexible tongue includes a metallic core, and the metallic core is preferably covered at least at the opposite end by plastic, for instance transparent and UV light resistant plastic.

In another aspect of the present invention, the cushion includes more than one flexible tongue, for instance two flexible tongues. The second flexible tongue may have substantially the same shape or may be made with the same material of the first flexible tongue. The second flexible tongue is substantially parallel to the first flexible tongue at rest, and the first and second flexible tongues are attached to each other at the end, through which they are also adapted to be attached to the section bar.

The attachment of the two tongues to the section bar may be realized in different ways. For instance, in one embodiment, one end of the second flexible tongue is adapted to be attached to the section bar and includes a flat surface adapted to be glued on a corresponding coupling surface of the section bar or to be attached thereto through female/male coupling. The first flexible tongue may be, in its turn, glued at its end to the end of the second flexible tongue, so as the end of the second flexible tongue is arranged between the section bar and the first flexible tongue.

In one embodiment, a length of the second flexible tongue which is arranged closer to the section bar, during use, is shorter than a length of the first flexible tongue which is arranged closer to the upright, during use.

Different material may also be used for the first and second flexible tongue, to provide improved cushioning effect. For instance, the first flexible tongue may be more flexible than the second flexible tongue. The first flexible tongue and the second flexible tongue are at a predetermined distance at rest and are adapted to enter in contact with each other during use. With different flexibility of the tongues, for instance, with the second flexible tongue less flexible and shorter than the first flexible tongue, great advantages may be achieved. Indeed, during use, when a force is applied to the section bar, first the opposite end of the first flexible tongue enters in contact with the upright; then, depending on the intensity of the force, a greater surface portion of the first flexible tongue may enter in contact with the upright, for instance involving also a middle portion of the first flexible tongue; then, if the resistance of the first flexible force is not sufficient for compensating the force, a surface of the first flexible tongue which is opposite to the surface in contact with the upright, enter in contact with the opposite end of the second flexible tongue; the remaining portion of the second flexible tongue, for instance the middle portion thereof, enters in contact with the first flexible tongue in case the force applied to the section bar is not still sufficiently compensated.

According to other possible embodiments of the present invention, the first flexible tongue and the second flexible tongue may be attached to the section bar by means of a raceway. In the following description, it is disclosed an embodiment of the cushion in which the cushion includes a raceway and one flexible tongue only but all the features disclosed here below also apply to another embodiment in which the cushion includes a raceway and two different flexible tongues. Moreover, all the features disclosed here below with reference to the flexible tongue, for instance their shape (straight, curved, concave, convex, material, etc.) also apply to the embodiments already disclosed in which the cushion does not include any raceway.

The raceway has a substantially C-shaped cross-section to fasten the cushion to an edge of the section bar, wherein the end of the flexible tongue towards the section bar is attached to the raceway.

As already explained above, at rest, for example in the absence of wind, the tongue is lying between the section bar and the upright, and in operating conditions, for example when the wind pushes the section bar towards the upright, it is deformed between them, preventing the contact therewith.

In one embodiment, the opposite end of the flexible tongue projects out from the raceway in a direction parallel to an axis of the raceway. In such embodiment, preferably, the flexible tongue is concave with respect to a side surface of the raceway to which the end of the flexible tongue is attached or to surface of the section bar.

In another embodiment, the opposite end of the flexible tongue at rest is substantially vertically aligned with an end of one side of the raceway opposite to an end at which the end of the tongue is attached. In such embodiment, preferably, the flexible tongue is convex with respect to a surface of the one side of the raceway.

More particularly, according to an embodiment of the present invention, the tongue is straight in rest conditions. For example, the tongue at rest is perpendicular to the raceway and it is curved when it is compressed between the upright and the section bar, in operating conditions. According to an alternative embodiment, the tongue is always straight at rest but it has a predetermined angle with respect to the raceway or with respect to a frame contact surface (or with respect to the section bar, when directly attached thereto). Without limiting the scope of protection of the invention, the raceway has a C-shaped cross section, it is equipped with a bottom and two side walls with a predetermined length, and the tongue is formed on a side wall, for example coplanar to the bottom, preferably on the whole length of the raceway. Alternative embodiments are provided, in which the tongue is perpendicular to the side wall but not coplanar to the bottom or in which the tongue does not cross the whole length of the raceway.

The Applicant has also thought up an upright suitable to cooperate with the cushion and to improve the flexion of the tongue. In particular, the upright is preferably made of aluminium and it is equipped with a curved outline suitable to facilitate the curvature of the tongue towards the raceway, in the compression step of the plastic outline on the upright, thus preventing the tongue from bending in an undesirable direction.

According to another aspect of the invention, the tongue has a predetermined curvature also in rest conditions and it is deformed between the upright and the section bar in operating conditions, assuming a different curvature.

The tongue is pre-loaded due to a predetermined shape and/or dimensional factor, in order to space the section bar from the upright, in the absence of wind, which allows the cloth to be tightened between the uprights, and it is also flexible, with shape memory, in order to allow the section bar to be brought nearer to the upright, under the action of the wind, preventing sudden movements thereof.

In an aspect of the invention, the cushion is shaped as a spring clip, and it is applicable by shape coupling to the section bar; for example, the cushion raceway is snap inserted in the section bar and the tongue has an end on the raceway and an opposed end turned towards the upright. Preferably, the tongue is extruded or co-extruded enbloc with the raceway.

According to this aspect of the invention, the cushion is directly applicable on an upright section bar and the flexible tongue is turned towards the upright and it serves as a spacer. A plurality of cushions are applicable along a single section bar, in order to cushion the contact with the respective upright, along the whole upright; in particular, the section bar has the same length as the upright and it is associated to and it keeps slidingly a first edge of the piece of cloth in the upright. A plurality of cushions are applicable on the section bar of the opposed upright of the window, which is coupled to the other edge of the piece of cloth.

According to this solution idea, the above-explained technical problem is also solved by a cushion for shading system of the type comprising an upright section bar along an opening to be shaded, including a raceway with a substantially C-shaped cross section, suitable to be fitted, preferably snap inserted, on a section bar edge, and a plastic tongue having an end on the raceway and an opposed end spaced therefrom, at least one portion of said tongue being flexible, in order to cushion the contact between the upright and the section bar. Advantageously, the upright and the section bar never come into contact with each other and the stresses, exerted by the wind or by the user on the piece of cloth during the shading system closing or opening, are discharged on the flexible tongues, which come nearer to the raceways without however coming into contact therewith. Same advantages, are obtained with a cushion having one or more flexible tongues directly attached to the section bar (i.e. with cushion not provided with a raceway).

According to several aspects of the present invention, in the absence of compression, the flexible tongue can be straight or sloping with respect to the raceway or curved. The tongue is elastically deformable and outside the raceway.

According to an aspect of the invention, a raceway bottom has a predetermined width and two raceway sides are convergent from the bottom towards the opening of the C-shaped cross section, in order to realize a pressing contact on the section bar edge, the parties being assembled. Advantageously, according to this aspect of the invention, the cushion is firmly fixed to the section bar edge since it is insertable until the raceway bottom abuts against the edge and it is kept by the sides which press on the section bar surface. To this purpose, the sides are advantageously flexible and with shape memory, and they exert a predetermined pressure on the section bar.

According to another aspect of the invention, at least one of the sides comprises a flange with a tip turned towards the bottom of the raceway, which hooks in one thickness of the section bar delimiting a groove. Preferably, the insertion of the flange into the groove is by snapping. For example, the flange is associated to a distal portion of the side which delimits the C-shaped opening, and it is flexible in order to bend towards the side during the insertion of the raceway in the section bar. Advantageously, the flange improves the coupling between the cushion and the section bar and it keeps the correct positioning thereof, when being used.

According to a preferred aspect of the invention, one side of the raceway is substantially perpendicular to the bottom and the other side, till more preferably the side with the flange, is sloping towards the opening of the C-shaped cross section, and it reduces the width thereof at rest. According to this aspect of the invention, the tongue end belonging to the raceway is associated to the side being perpendicular to the bottom. Advantageously, according to this structure, a distal portion of the tongue applied to a section bar appears substantially parallel to an upright surface and it provides a supporting surface, on which cushion is made.

Even more particularly, the tongue end is associated to an end of the side and the opposed tongue end is substantially aligned with the other end of the side, when the tongue is at rest. During the contact with the upright, said opposed tongue end, which forms the supporting surface, bends towards the side.

The raceway has preferably a length L of about 2 cm. The opposed tongue end at rest, is about 1 cm away from the side. There is nothing to prevent the size from being different, however not changing the solution idea on which the invention is based.

To this purpose, the Applicant has noticed that with a cushion system comprising a plurality of cushions of the above-described type, and assembled with a predetermined pitch on a section bar of a shading system, for example with a pitch comprised between 5 cm and 15 cm, surprising results are obtained in terms of quietness of the shading system.

According to another aspect of the present invention, which concerns the cushion composing material, the Applicant has noted a particular advantage in using polypropylene with an extrusion method.

The above-explained technical problem is also solved by a cushion system according to the present invention comprising a plurality of cushions of the above-described type, assembled with a predetermined pitch on an edge of an upright section bar. Preferably, these cushions are assembled on two opposed edges of the section bar and the latter is equipped with a rib, between the two edges, having a fissure for housing a piece of cloth edge. The pitch of the cushions on the edges is predetermined, preferably at 5-15 cm.

According to an aspect of the invention, the section bar edge whereon the cushion raceway is fitted comprises a portion of reduced thickness serving as a raceway draft and a groove for hooking the tip of the cushion flange, preferably for a snap insertion.

As already explained, the cushion system may include a plurality of cushions without raceway. For instance each cushion of the cushion system has a flexible tongue directly attached to the section bar, i.e. assembled or glued with a pitch on an edge and/or on opposed edges of an upright section bar.

The technical problem is also solved by a section bar for a frame upright, comprising an edge insertable in a cushion raceway. The edge has a portion of reduced thickness which serves as a raceway draft, preferably said reduced thickness being lower or equal to the opening of the raceway C-shaped cross section at rest and the remaining edge portion having a thickness being higher or equal to the opening of the C-shaped cross section at rest, said section bar delimiting a longitudinal groove, preferably in correspondence with said remaining portion, suitable to receive by snapping the tip of the raceway flange in order to hook the raceway to the section bar. The section bar is preferably equipped with opposed edges with respect to a central rib in which the piece of cloth is fastened and the edges are suitable to house a plurality of cushions. According to this embodiment, the reduced edge facilitates and speeds up the assembly of the cushions on the upright section bars.

In an embodiment covered by the present invention, which also solve the technical problem mentioned above, the section bar include a plurality of female elements in which a plurality of corresponding male elements are inserted, preferably removable. In this case, no raceway is provided on the cushion.

Further features and advantages of the cushion and section bar of the system according to the present invention will be apparent from an embodiment thereof, given only by way of not limiting example with reference to the attached figures.

DETAILED DESCRIPTION

Figure 1A:
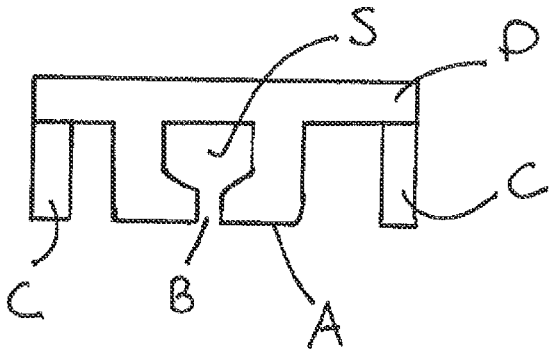
FIG. 1a (prior art)
FIG. 1*a* is a front cross section of the section bar of FIG. 1.
Figure 1:
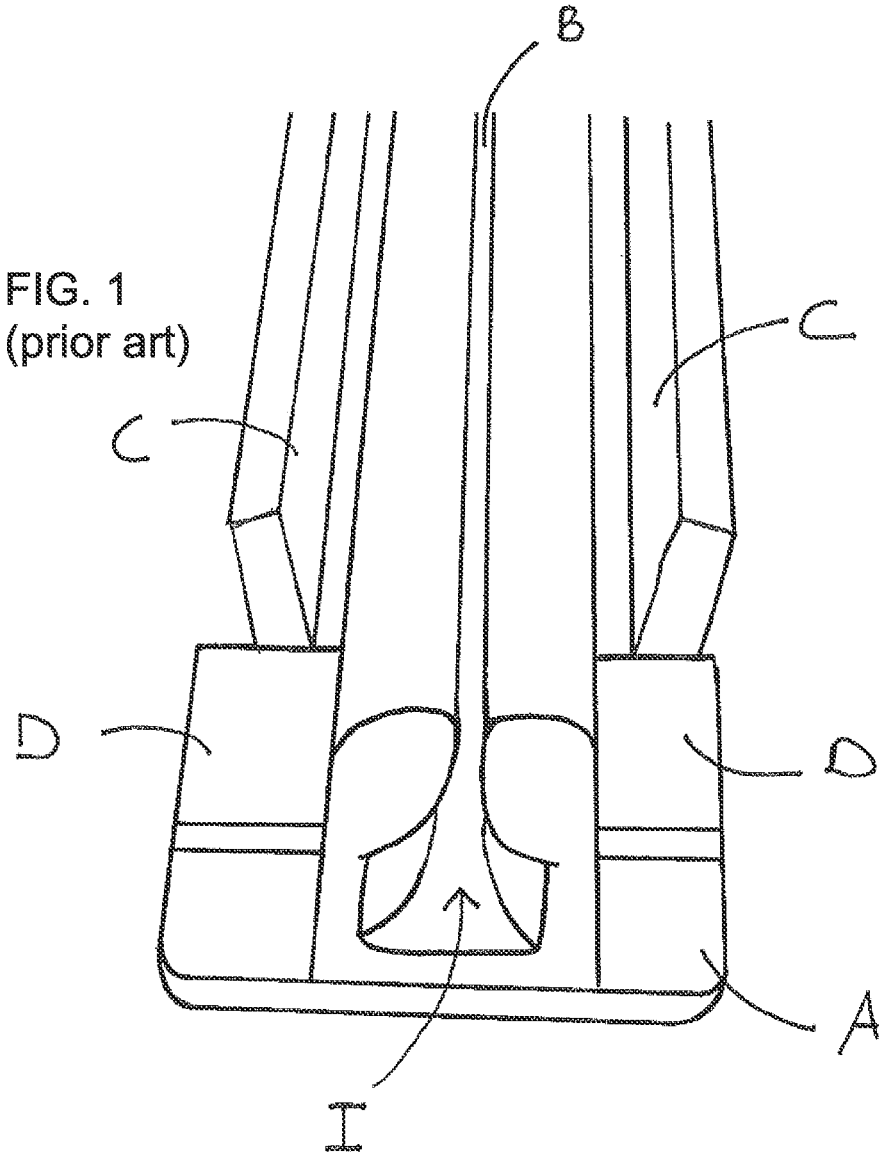
FIG. 1 (prior art)
FIG. 1 is a detail of a section bar with a little sponge according to the prior art.
Figure 2:
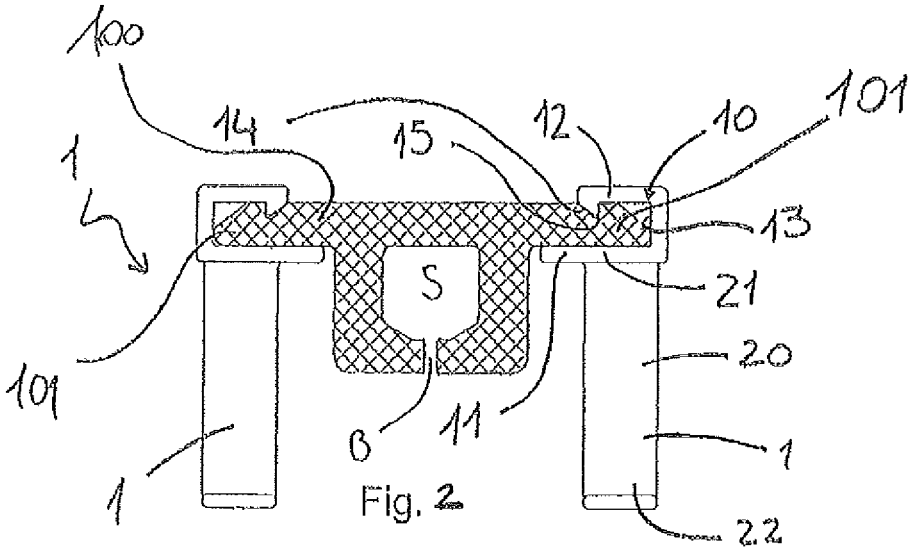
FIG. 2 is an assembled front cross section of a section bar and of two cushions, according to the present invention.

FIG. 2 is cross-sectional view of two cushions 1, according to the present invention, applied to a section bar 100 of an upright, for example an upright integrated in a frame of a window to be shaded, substantially having the same length as the window. The section bar 100 is a longitudinal element substantially of the same length as the upright and it has a seat S for an edge of a shading piece of cloth which comes out of the section bar 100 and of the respective upright through a fissure B of the section bar. The piece of cloth edge remains in the seat for example since it has a higher thickness than the width of the fissure B, preventing the piece of cloth from detaching from the section bar. Another section bar 100 is associated to an opposed frame upright.

Figure 3:
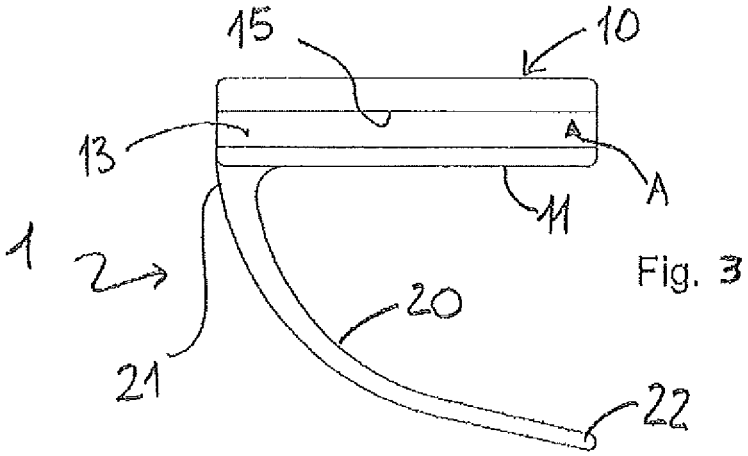
FIG. 3 is a side view of the cushion of FIG. 2.
Figure 4:
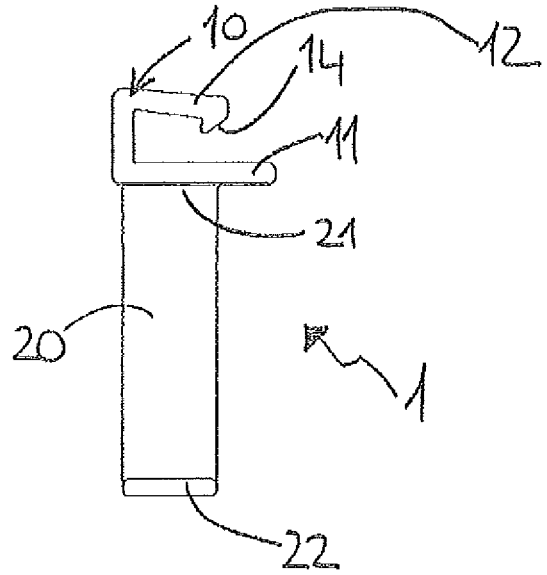
FIG. 4 is a detail of the cushion of FIG. 2.

According to the invention, the cushion 1 comprises a raceway 10, also indicated in FIGS. 3-4, with a substantially C-shaped cross section which serves to fasten the cushion to a section bar edge 101, and a flexible plastic tongue 20 and with shape memory, having an end 21 on the raceway and a opposed end 22 spaced therefrom in order to remain in contact with the upright; the tongue serves as a spring between the section bar and the upright, allowing the section bar to come nearer to the upright in the compression step or to be spaced in a predetermined way in the absence of compression.

The tongue extends outside the raceway. According to different embodiments of the cushion, it is provided that the tongue extends in the direction along which the shading piece of cloth is intended to extend or in the opposite direction.

Figure 5:
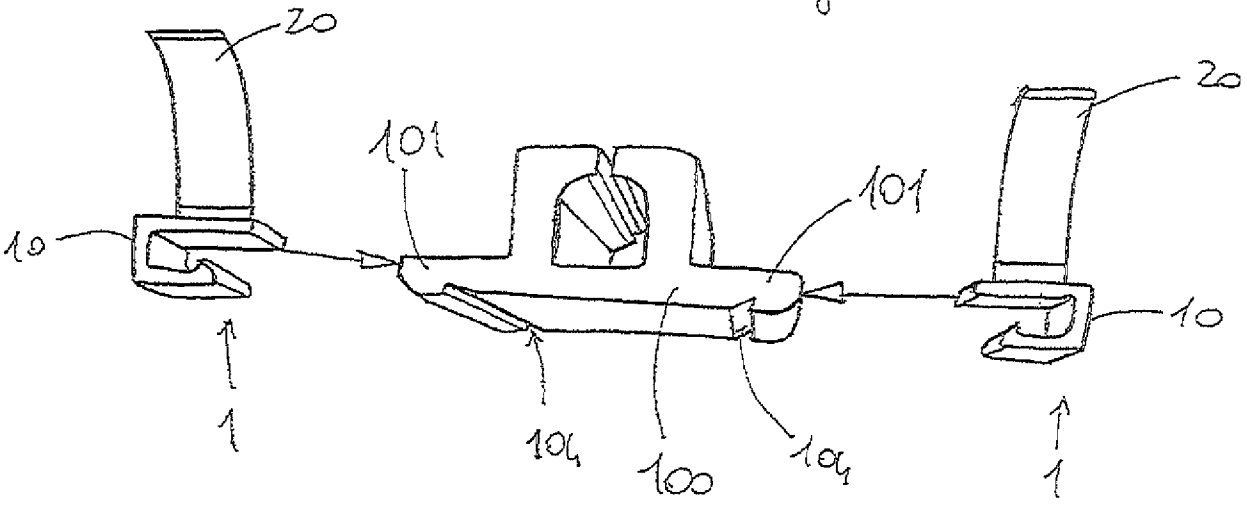
FIG. 5 is an exploded perspective view of the section bar and of the cushions of FIG. 2.
Figure 6:
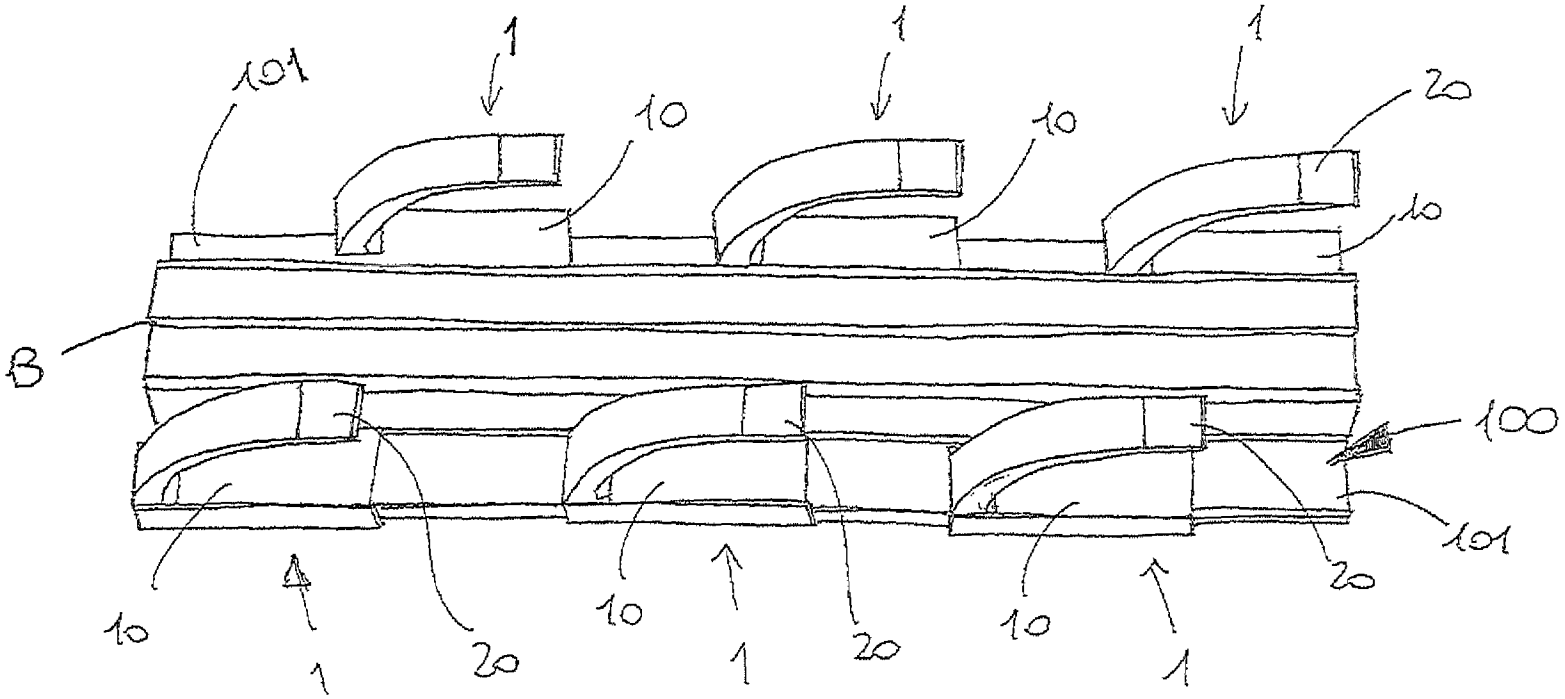
FIG. 6 is a different perspective view of the section bar and of a plurality of cushions, according to the present invention.

Substantially, the shape and/or the size of the tongue represents a pre-load of the tongue which spaces not only the end 22 from the raceway but also the section bar from the upright, when assembled. This aim is improved by the application of a plurality of cushions, as represented in FIG. 6, preferably on opposed sides or edges of the section bar, with respect to fissure B. For example, each raceway is about 2 cm long and a plurality of cushions are fitted through the respective raceways on the section bar, with a pitch of 10-15 cm. FIG. 5 schematically shows the detached parts, i.e. two cushions 1 suitable to be fitted on opposed edges 101 of the section bar 100.

According to an aspect of the invention, a bottom 13 of the raceway 10, for example indicated in FIGS. 2 and 3, has a predetermined width B and two sides 11, 12 of the raceway are preferably convergent from the bottom 13 towards the opening of the C-shaped cross section, in order to make a pressing contact on the section bar, i.e. on a supporting surface thereof. A flange 14 with a tip 15 turned towards the bottom 13 is provided on one side 12, which hampers the section bar going out of the raceway 10. To this purpose, a groove 104 is provided in a thickness of the section bar (FIG. 5) suitable to receive by snapping the flange 14 of the raceway.

Figure 8:
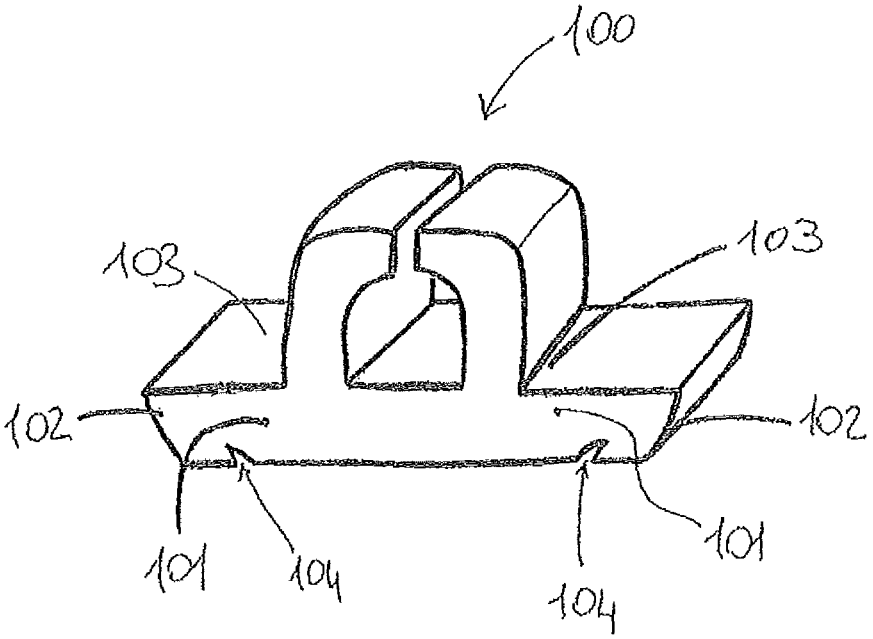
FIG. 8 is a perspective view of the section bar according to the present invention.
Figure 7:
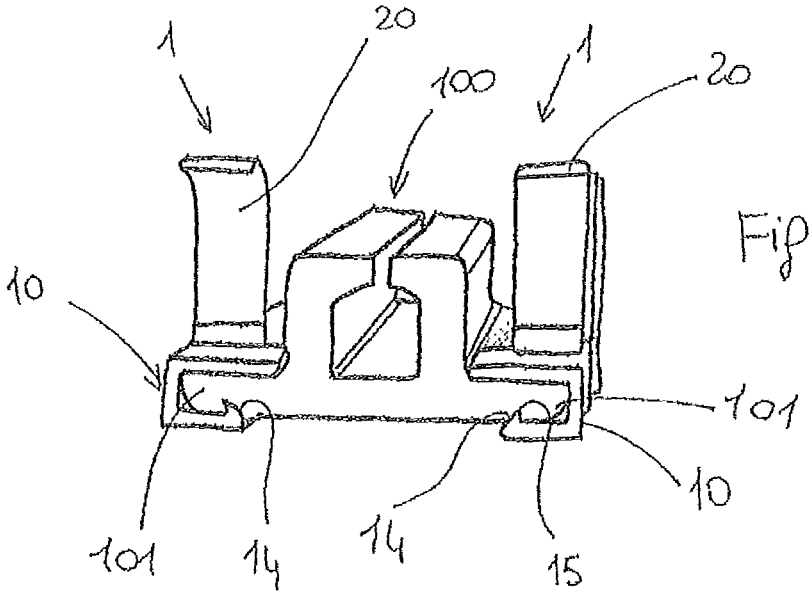
FIG. 7 is a further perspective view of the section bar and of the cushions of FIG. 6.

The Applicant has also devised an advantageous section bar which allows the cushions to be applied automatically, rapidly and cheaply, as schematically represented in FIG. 8. This section bar has an edge 101 whereon the raceway 100 is to be fitted and it comprises a portion of reduced thickness 102 which serves as a raceway draft 10, and a groove for hooking the tip 15 of the flange 14, preferably for snap hooking; the edge 101 of the section bar 100 comprising a remaining portion 103 with a thickness being higher or equal to the opening of the raceway C-shaped cross section at rest. The longitudinal groove 104 is preferably in correspondence with this remaining portion 103.

Preferably the reduced thickness is lower than the opening of the raceway C-shaped cross section at rest, i.e. when it is not fitted on the section bar, and the remaining portion 103 of the edge has a thickness being higher or equal to the opening of the C-shaped cross section at rest. The insertion in the longitudinal groove 104 of the tip 15 of the flange 14 is by snapping.

The portion of reduced thickness 102 is given by rounding off or bevelling the edge 101, preferably on the section bar side concerned by the longitudinal groove 104. According to this aspect of the invention, when the cushion 1 is inserted in the section bar, the side 12 of the raceway 10 engages first the bevelling or rounding 102 and it is brought away from the other side 11, as it engages the portion of increased thickness 103, and until the tip 15 of the flange 14 hooks the groove 104. Such a shape of the section bar allows the cushions to be automatically hooked and, i.e., to be applied by industrial automation, substantially without labour.

Still with reference to FIGS. 2-4, a side 11 of the cushion raceway 10 is substantially perpendicular to the bottom 13 and the other side 12, preferably the side 12 with the flange 12, is sloping towards the opening of the C-shaped cross section, reducing the width thereof at rest, when it is not applied to the section bar. For example, the end 21 of the tongue 20 belonging to the raceway 10 is associated to the side 11 being perpendicular to the bottom 12. In an embodiment of the invention, the tongue end 21 is associated to an end 24 of the raceway 10 and the opposed end 22 of the tongue 20 at rest is substantially aligned with the other end 25 of the raceway 10.

Figure 9:
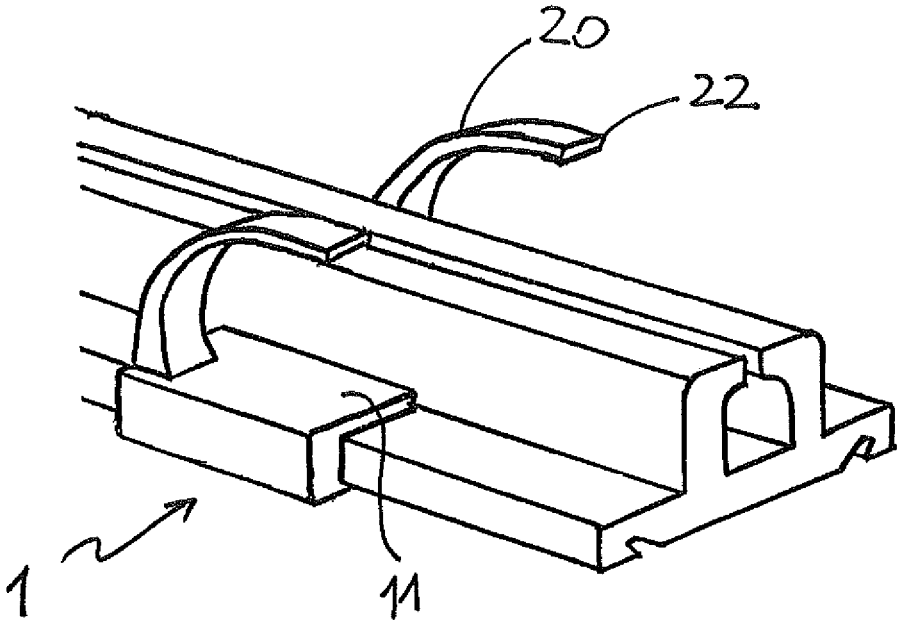
FIG. 9 is an image of the section bar and of two cushions according to the present invention.
Figure 10:
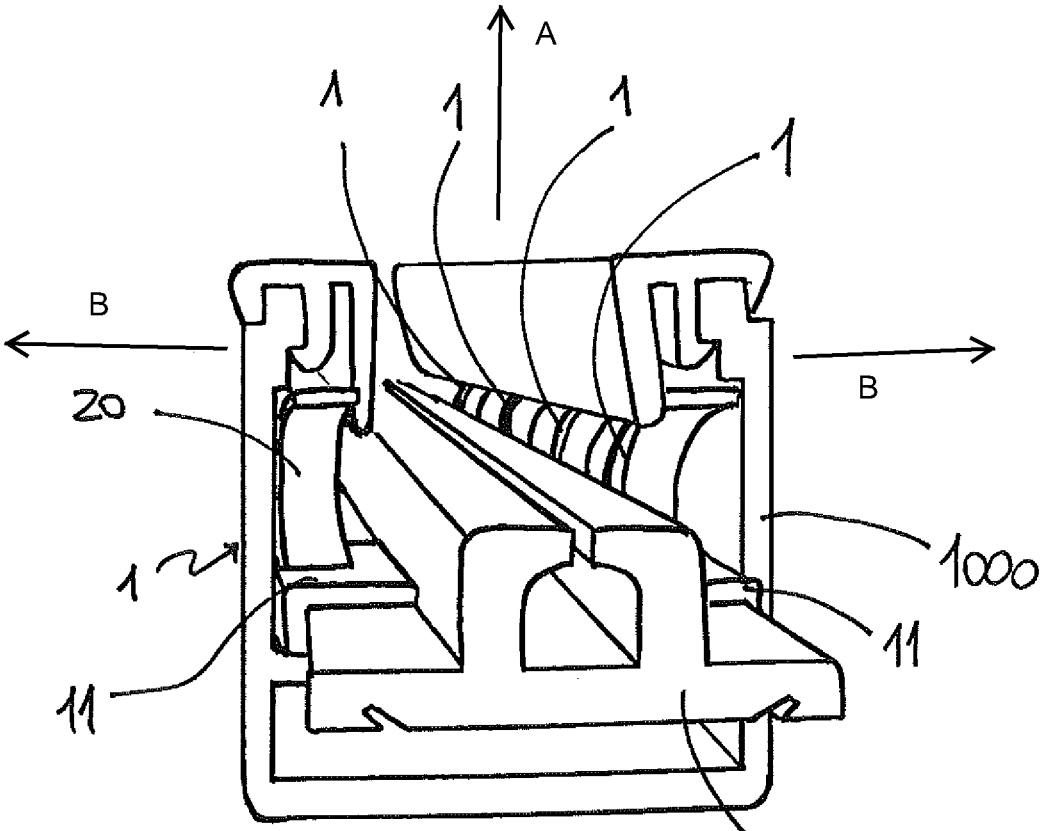
FIG. 10 is an image of the section bar and of the cushions of FIG. 2, inserted in an upright.
Figure 11:
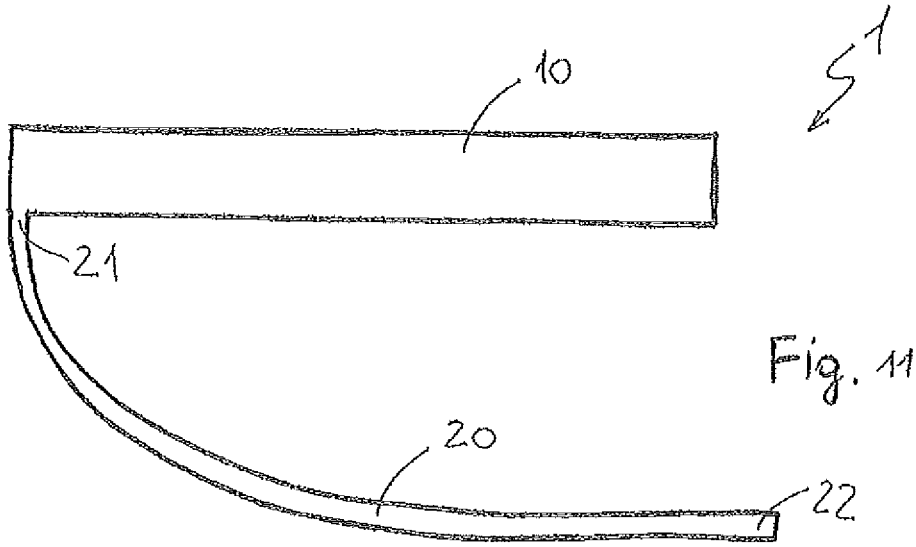
FIGS. 11-14 are different side, front and perspective views of the cushion of FIG. 3.
Figure 12:
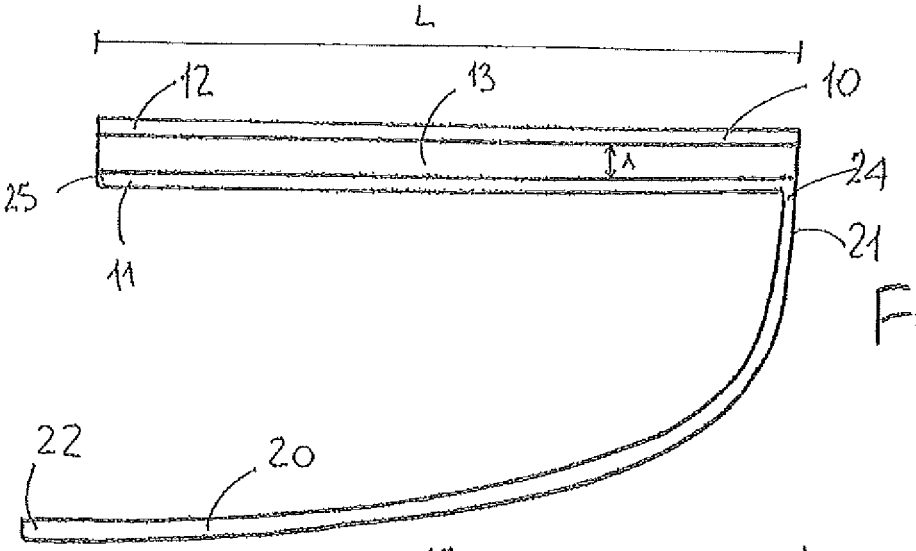
Figure 13:
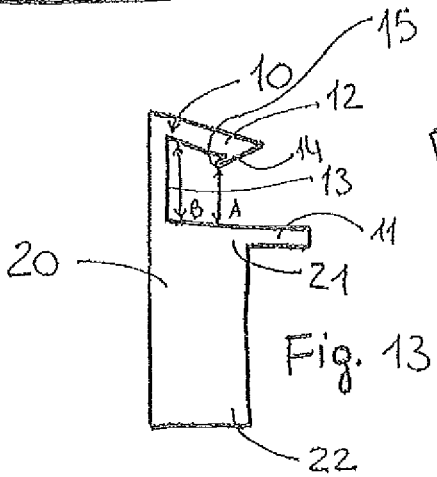
Figure 14:
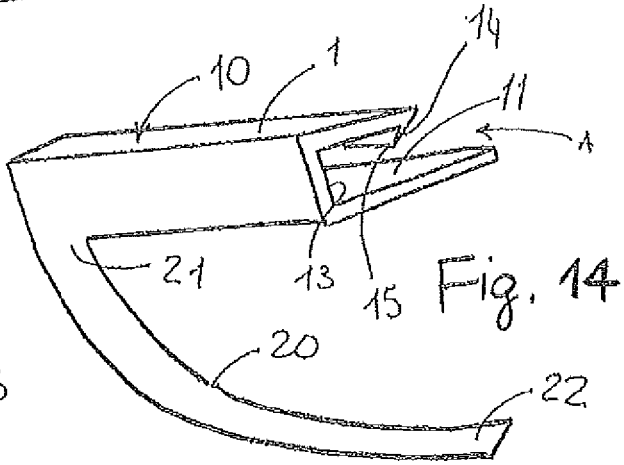

FIG. 9 is an image of a section bar portion on which two cushions are already fastened and FIG. 10 is an image of this section bar inserted in the thickness of an upright 1000. As it can be noted, the end 22 of the tongue 20 contacts the upright 1000 or it is very close in order to carry on at once the spring function if the piece of cloth (not represented) drags the section bar 100 towards the upright.

With reference to FIGS. 15*a*-15*d* some embodiments of the plastic cushion 1 according to the present invention are described, in which the plastic tongue is not curved.

The cushion is applicable to a section bar and it has a tongue 20 with a free end 20*a* suitable to be turned towards the upright, when being used, preferably always in contact therewith, and an opposed end 20*b* on a cushion raceway 10. The raceway 10 appears applicable to the section bar, for example insertable by quick coupling on an edge of the section bar, as already described.

The tongue is flexible. At rest, for example in the absence of wind, the tongue 20 is extended between the section bar and the upright, and in operating conditions, for example when the wind pushes the section bar towards the upright, it is deformed between them, preventing the contact therewith.

More particularly, the tongue is straight in rest conditions (FIG. 15*a*-15*d*). For example, the tongue 20 at rest is perpendicular to the raceway (FIG. 15*a*-15*c*) and it is curved or sloping with respect to the raceway, when it is compressed between the upright and the section bar. According to an alternative embodiment, the tongue is always straight at rest but it has a predetermined angle (FIG. 15*d*) with respect to the raceway 10 or with respect to a frame contact surface (not represented).

Figure 15A:
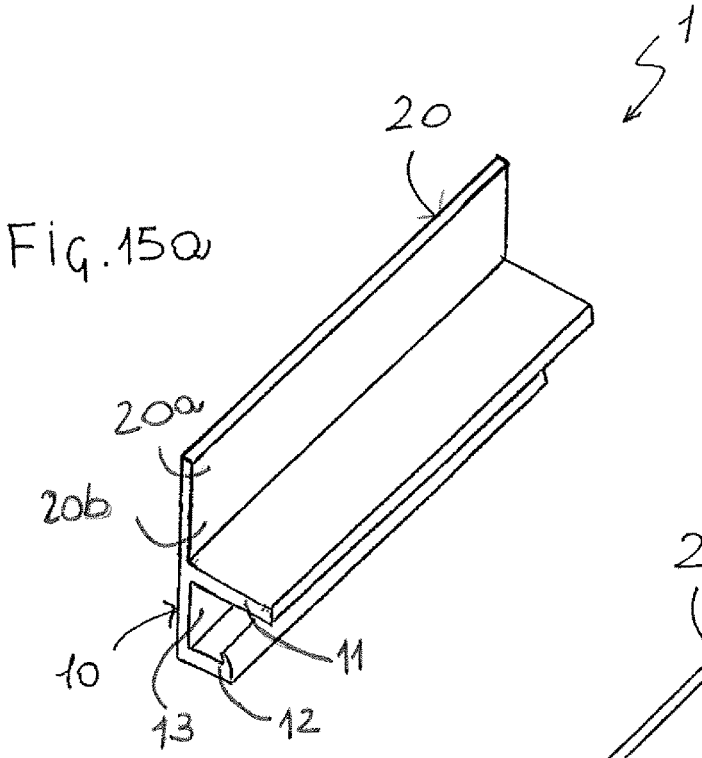
FIGS. 15*a*-15*d*, 16, 17 are different embodiments of the cushion according to the present invention.
Figure 15B:
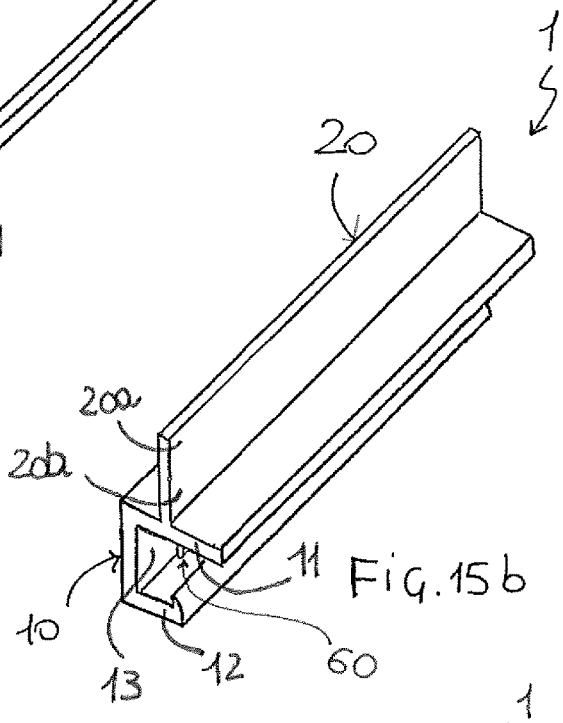
Figure 15C:
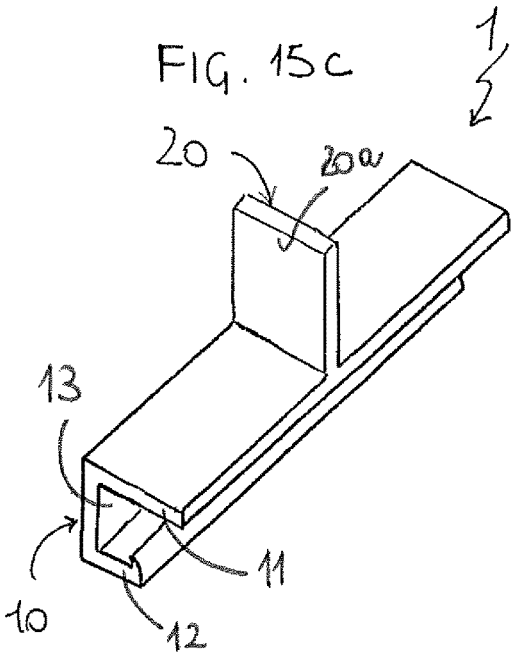
Figure 15D:
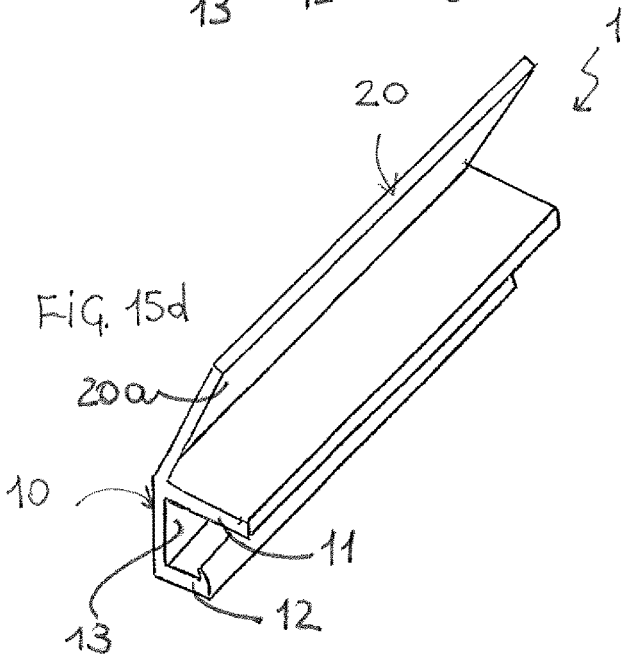

The raceway has a C-shaped cross section, and it is equipped with a bottom 13 and two side walls 11, 12 of predetermined length, and the tongue 10 is formed on a side part 11, for example coplanar to the bottom 13, preferably on the whole length of the raceway 10 (FIG. 15*a*, 15*b*, 15*d*). Some alternative embodiments are provided, in which the tongue 10 is perpendicular to the side wall 11 but not coplanar to the bottom 13 or in which the tongue 20 does not cross the whole length of the raceway 10.

In a preferred embodiment, for example represented in FIG. 15*b*, a protrusion or pin 60 is formed under one side 11 of the raceway 10, suitable to be inserted in a section bar hole, as represented in FIG. 15*b* by way of example. The pin 60 increases the hold of the raceway on the section bar. Moreover, multiple holes on the section bar, preferably equidistant, allow the hooking positions of the cushions to be predetermined.

Figure 16:
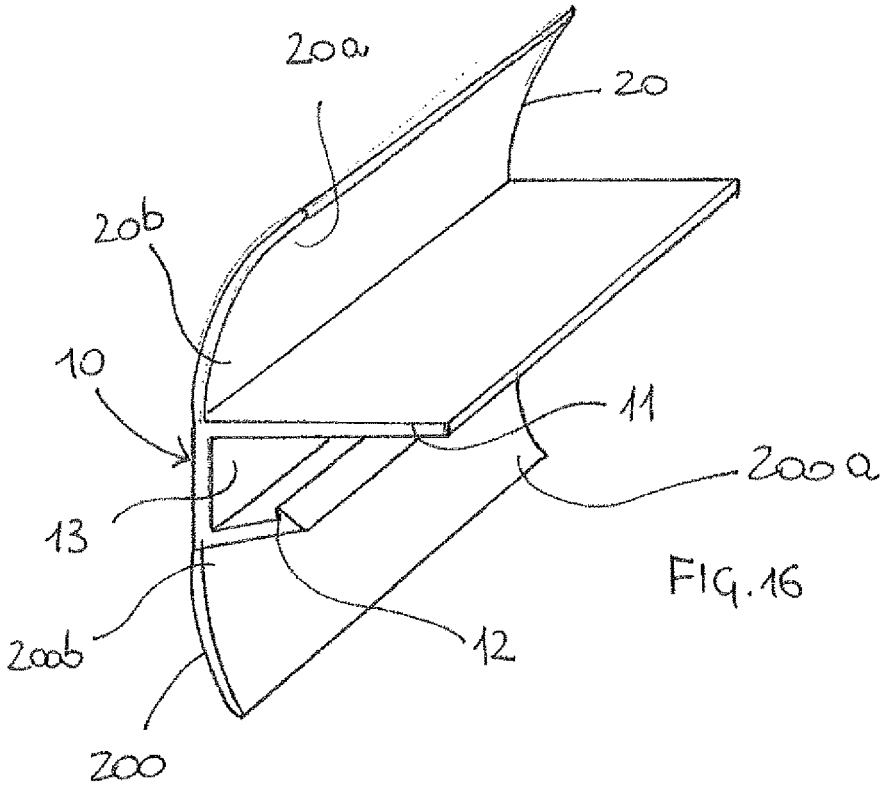
Figure 17:
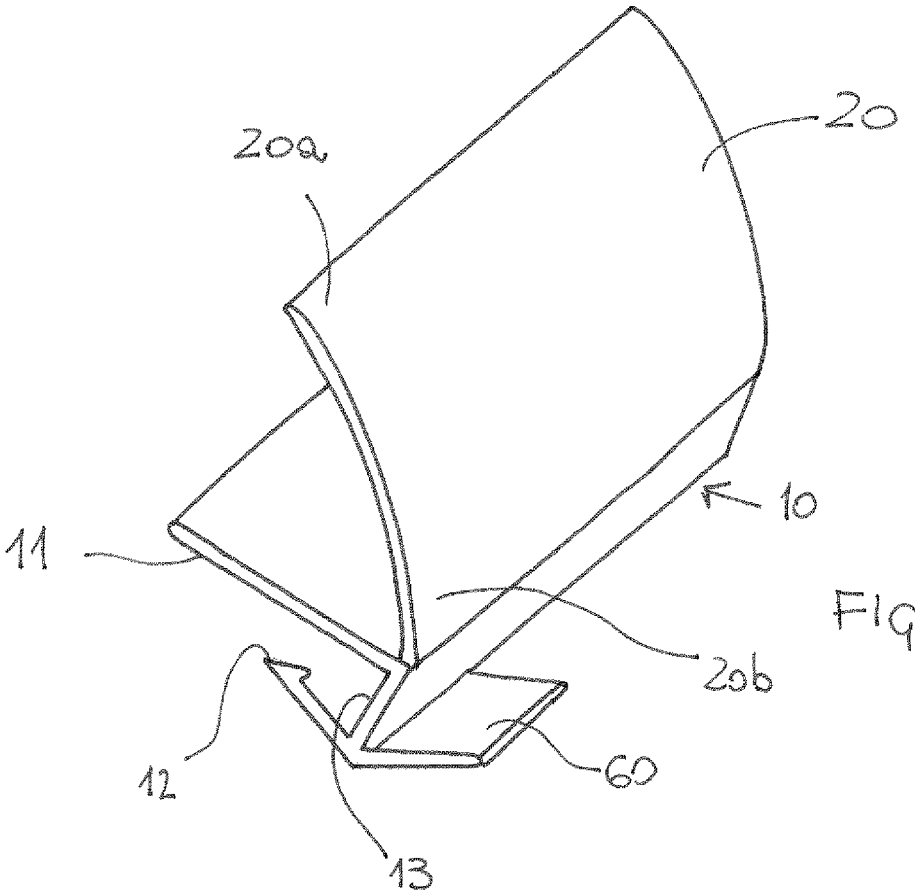
Figure 18:
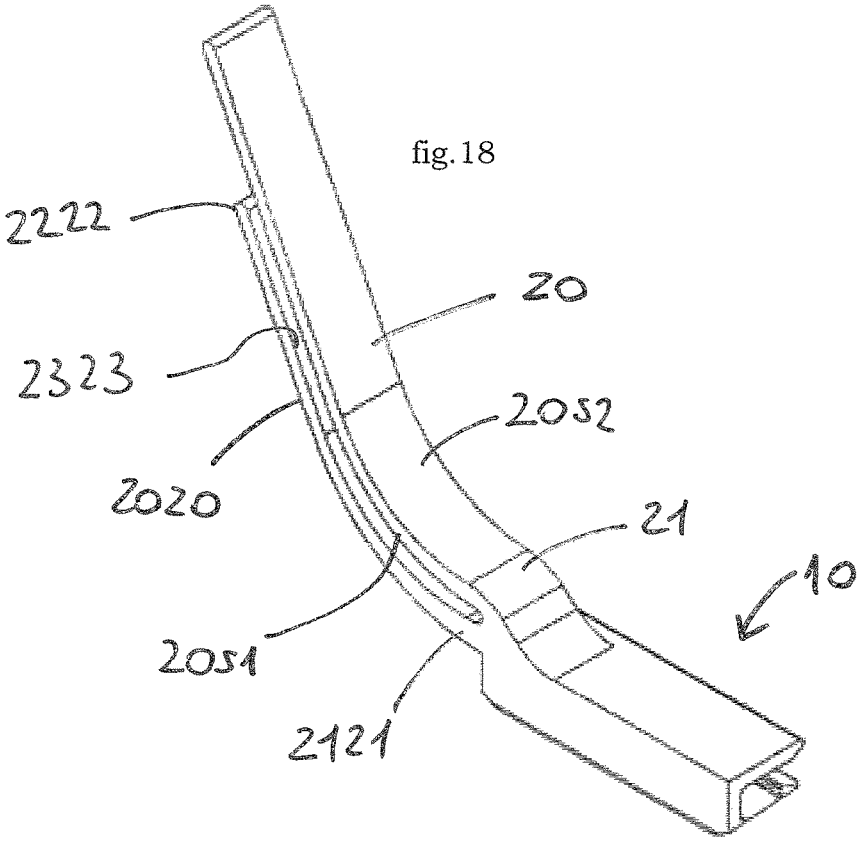
FIGS. 18-24 are different view of another embodiment of the cushion according to the present invention.
Figure 19:
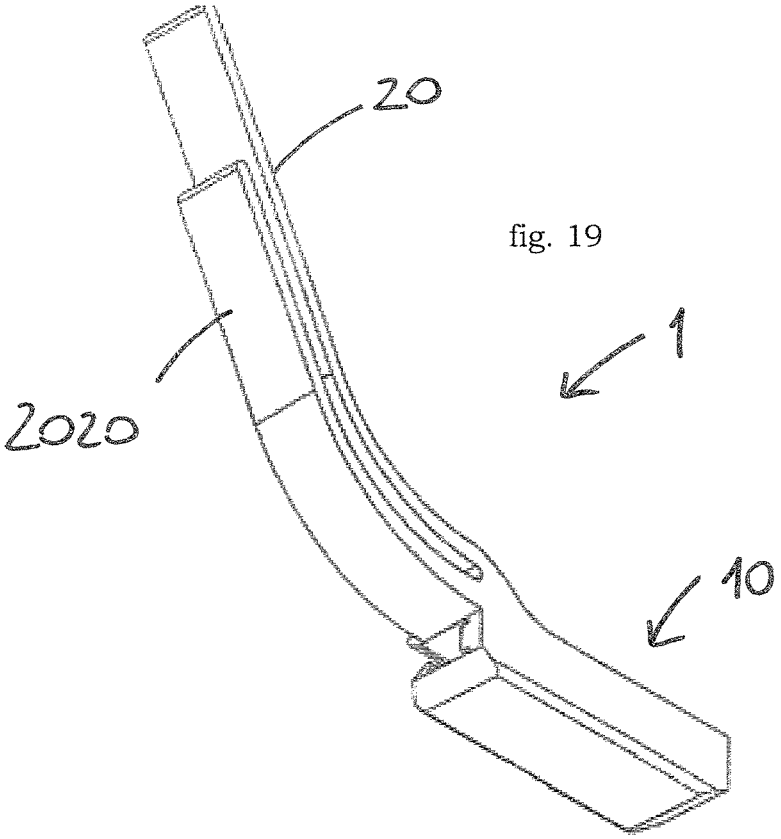
Figure 20:
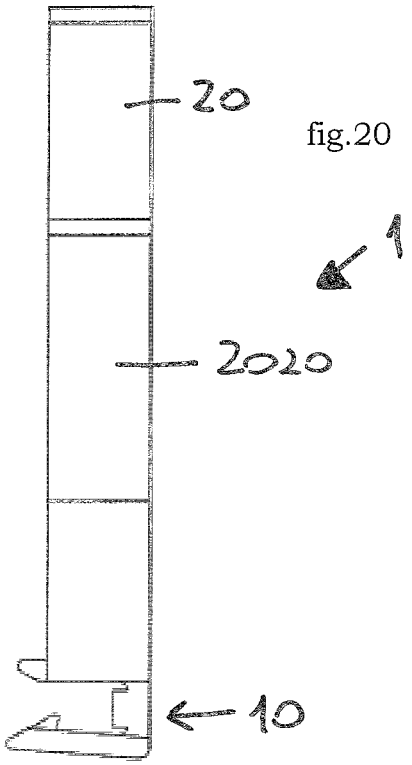
Figure 21:
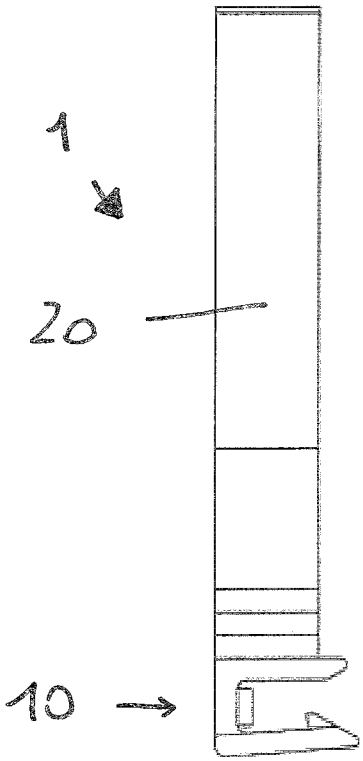
Figure 22:
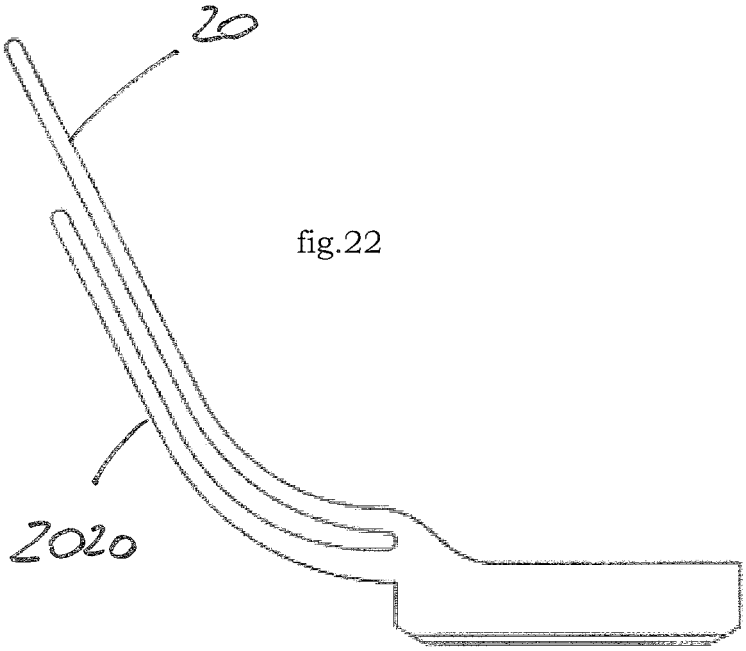
Figure 23:
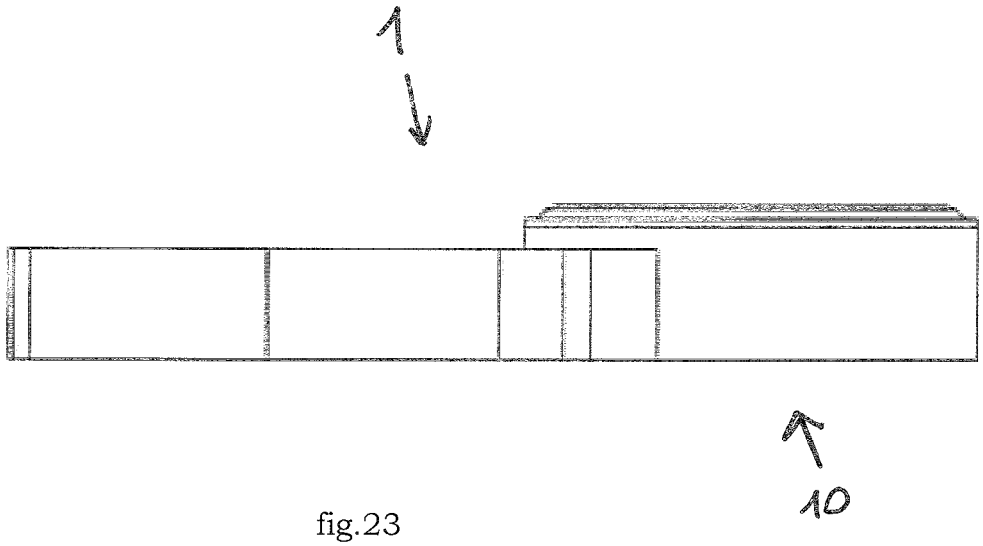
Figure 24:
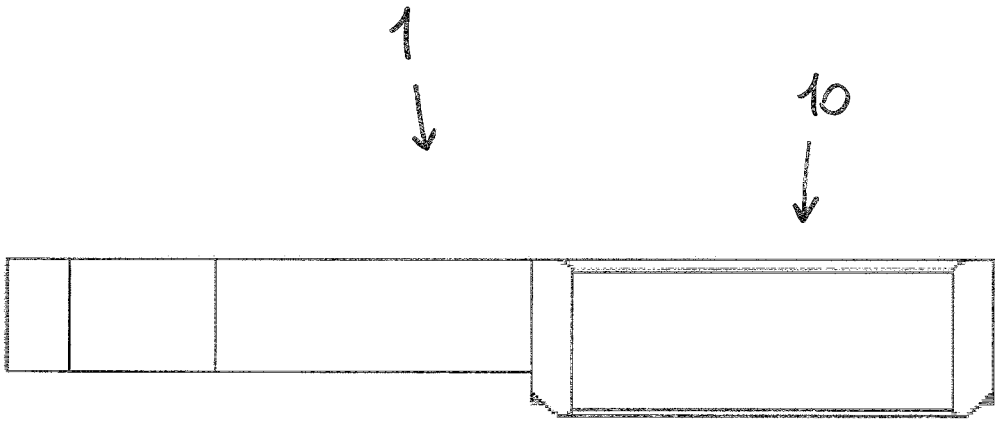

In a particularly advantageous embodiment of the present invention, the raceway has two opposed tongues 20 and 200, substantially extending over and under the raceway 10, outside it, which serve as cushions between the upright and the raceway during opposed movements of the section bar within the upright. In particular, as represented in FIG. 16, a second tongue 200 with an end 200*b* on the raceway and an opposed end 200*a* spaced therefrom, specular on the raceway to the first tongue 20, is intended to contact an upright surface substantially opposed to the upright surface intended to come into contact with the first tongue, and it serves as a spring between the section bar and the upright, allowing the section bar to come nearer to the upright in the compression step or to be spaced in a predetermined way in the absence of compression. Substantially when the first tongue is compressed, the second tongue is extended, and vice versa.

According to this embodiment, the first and second tongue extend in the direction along which the shading piece of cloth is intended to extend and also in the opposite direction. For example, the tongues 20 and 200 are curved at rest.

According to the present invention, on the bottom 13 of the raceway 10, and in particular on the surface of the bottom 13 outside the raceway 10, a plastic fin 60 is formed, which extends along the whole raceway or along a raceway length. The fin 60 serves as a side cushion between the bottom 13 of the raceway 10 and the upright. The fin 60 is particularly useful when the wind strikes perpendicularly the piece of cloth, determining not so much the movement of the piece of cloth between the two uprights (direction A, in FIG. 10) but the movement of the piece of cloth in each of the two uprights (direction B, in FIG. 10). The fin 60 can be realized in any of the embodiments according to the present invention.

The Applicant has also thought up an upright suitable to cooperate with the cushion 1 and to improve the flexibility of the tongue 20. In particular, the upright is preferably made of aluminium and it is equipped with a curved outline suitable to facilitate the curvature of the tongue 20 towards the raceway 10, in the compression step of the plastic section bar on the upright, thus preventing the tongue 20 from bending in an undesirable direction.

The advantages of the cushion of the present invention are the following. The tongue spaces to a predetermined extent the section bar from the upright in the absence of stresses and this predetermined extent corresponds to an optimal tension of the piece of cloth between the uprights, keeping a contact with the upright, through the tongue, which allows the effect of the stresses caused by the wind or by the opening and closing operations on the piece of cloth to be cushioned, which affect the section bar, moving it towards the upright. The tongue spring effect prevents the section bar/upright contact and also sudden movements of the section bar in the upright.

The particular shape of the conceived section bar allows instead the application of the cushions on the section bar edge to be automated and considerably sped up. In fact, the substantially square edge of known section bars forces the raceway to be opened by hand in order to fit the cushion on the edge while the draft of the edge with reduced thickness, being it bevelled or rounded, according to the present invention allows the cushion to be fitted without acting on the raceway: as the raceway is fitted on the edge, the sides thereof are opened wide by the thickening of the section bar edge up to reaching the groove in which the fin is engaged;

at this point the sides get nearer again by snapping the one towards the other, fastening to the section bar.

Figure 25:
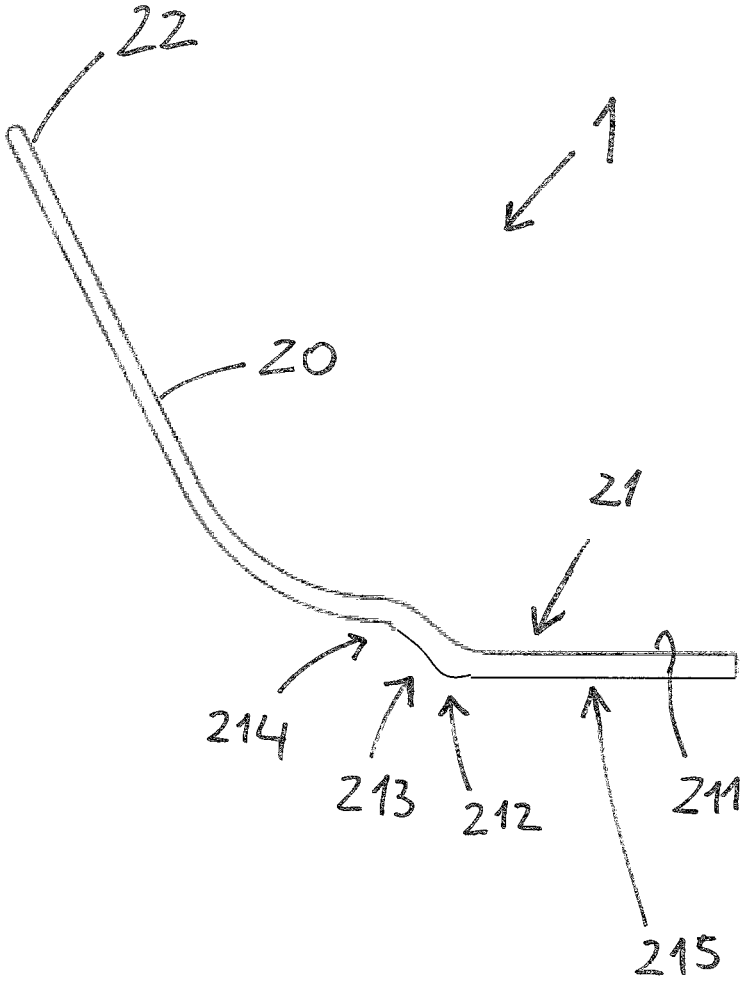
FIG. 25-26 are further embodiments of the cushion according to the present invention.

With reference to FIG. 25 another embodiment of the present invention is disclosed, wherein a cushion 1 for a shading system of a type including a piece of cloth slidingly fastenable to a section bar of an upright includes a flexible tongue 20 having an end 21 adapt to be attached to the section bar and an opposed end 22 adapt to be spaced therefrom to contact the upright and to serve as a spring between the section bar and the upright, allowing the section bar to come nearer to the upright in a compression phase or to be spaced in a predetermined measure in an absence of compression.

The end 21 of the flexible tongue 20 which is adapt to be attached to the section bar includes a surface 211, preferably flat, adapted to be glued on a corresponding coupling surface, preferably flat, of the section bar. In FIG. 25, the middle portion of the flexible tongue which is arranged between the end 21 and the opposite end 22 of the includes parts 212, 213, 214 with different curvatures, in particular a first portion 212 concave with respect to the flat surface of the end 21, a second portion 213 at a predetermined inclination with respect to the surface of the end 21 and a third portion 214 concave with respect to the surface of the end 21. However, nothing prevents that the middle portion have different shapes.

In another embodiment, the end of the flexible tongue is not glued to the section bar but attached thereto through male/female coupling means. For instance, a male element 217 is provided on a bottom surface 215 on the end 21 of the flexible tongue 20 and a female element is provided on the section bar (not represented). The male element 217 of the cushion may be a pin protruding from flat bottom surface portion 215 at the end of the flexible tongue; the pin may include a head 218 with a cross section and an annular portion 219 with a section smaller than the section of the head 218 between the head and a base portion 220 of the pin, the female element having a hole of a section corresponding to the section of the annular portion 219, adapted to retain the pin when the head is passed through the hole.

The flexible tongue preferably has a predetermined width and a predetermined thickness which are constant along the length of the flexible tongue, as it will be apparent also from another embodiment given with reference to FIGS. 18-24. In such embodiment, the cushion 1 further includes a second flexible tongue 2020 substantially parallel to the flexible tongue 20 at rest, wherein the first 20 and second 2020 flexible tongue are attached to each other at the respective end 21, 2121 where they are also adapted to be attached to the section bar.

Figure 26:
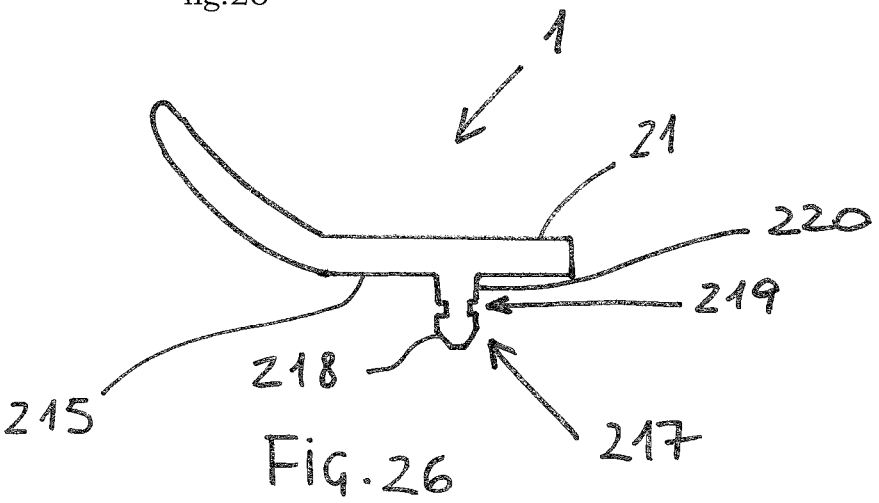

In this respect, with reference to FIGS. 18-24 the ends 2121 and 21 are attached to a raceway 10. However, according to another embodiment which is no represented, a cushion 1 of the type represented in FIG. 25 or 26 may comprise two different flexible tongues, one parallel to the other at rest, with the end of the first and second flexible tongue attached to the flat surface 211.

A length of the second flexible tongue 2020 which is arranged closer to the section bar, during use, is smaller than a length of the first flexible tongue 20 which is arranged closer to the upright, during use, for instance as represented in the embodiment of FIG. 18-24.

Depending on the type of application and usage conditions, different material may be used for the first and second flexible tongue. Preferably, the first flexible tongue 20 is more flexible than the second flexible tongue 2020, the first flexible tongue 20 and the second flexible tongue 2020 are at a predetermined distance at rest and are adapted to contact to each other during use, along a contact portion increasing with the force applied to the section bar.

With different flexibility of the tongues, for instance, with the second flexible tongue less flexible and shorter than the first flexible tongue, great advantages may be achieved. Depending on the flexibility and on the distance between the first and second tongue at rest, different way of cushioning may be provided.

For instance, when a force is applied to the section bar, the following may happened:

first the opposite end of the first flexible tongue 20 enters in contact with the upright;

then, if the intensity of the force is sufficiently high, a greater surface portion of the first flexible tongue 20 may enter in contact with the upright, for instance involving also a middle portion of the first flexible tongue, but without contact between the first 20 and second tongue 2020;

then, if the resistance of the first flexible force is not sufficient for compensating the force applied, a surface **20*s*1 of the first flexible tongue 20 which is opposite to the surface 20*s*2 in contact with the upright, enter in contact with the opposite end 2222 of the second flexible tongue 2020**;

at last, the remaining portion 2323 of the second flexible tongue 2020, for instance the middle portion thereof, enters in contact with the first flexible tongue 20 in case the force applied to the section bar is not still sufficiently compensated.

However, with a cushion having first and second tongues with different flexibility and distance, the cushioning may involve the following steps, in sequence:

first the opposite end of the first flexible tongue 20 enters in contact with the upright;

then, if the intensity of the force is sufficiently high, the surface **20*s*1 of the first flexible tongue 20 which is opposite to the surface 20*s*2 in contact with the upright, immediately enters in contact with the opposite end 2222 of the second flexible tongue 2020**;

then, a greater surface portion of the first flexible tongue 20 enters in contact with the upright, for instance involving also a middle portion of the first flexible tongue, which is deformed in the same way and together with the second flexible tongue backward, remaining in contact one to the other. The size of the contact portion between the first and second flexible tongues increases with the intensity of the force applied.

The invention claimed is:

1. A cushion system comprising:

a plurality of cushions for a shading system, each cushion of the plurality of cushions including:

a flexible tongue having an end attached to a section bar of the shading system and an opposed end spaced therefrom to contact an upright of the shading system, said flexible tongue serves as a spring between the section bar and the upright, allowing the section bar to come nearer to the upright in a compression phase or to be spaced in a predetermined measure in an absence of compression:

wherein a first set of the plurality of cushions are assembled with a predetermined pitch on one edge of the section bar and a second set of the plurality of cushions are assembled with a predetermined pitch on an opposed edge of the section bar;

wherein each pitch comprises a distance between neighboring cushions of the plurality of cushions along a longitudinal direction of either the one edge or the opposed edge of the section bar;

wherein the cushions of the first set of the plurality of cushions are separated from the cushions of the second set of the plurality of cushions, and the opposed end of each flexible tongue of the first set of the plurality of cushions and each flexible tongue of the second set of the plurality of cushions extend in a same direction and are all compressed in the compression phase in a direction perpendicular to a bottom portion of the section bar and each of the plurality of cushions leaves the bottom portion of the section bar free.

2. The cushion system according to claim 1, wherein the end of each flexible tongue, which is attached to the section bar, includes a flat surface glued on a corresponding coupling flat surface of the section bar.

3. The cushion system according to claim 1, wherein each flexible tongue has a predetermined width and a predetermined thickness that are constant along a length of the flexible tongue.

4. The cushion system according to claim 1, wherein each flexible tongue includes plastic.

5. The cushion system according to claim 4, wherein the plastic is at least one of transparent or UV light resistant.

6. The cushion system according to claim 1, wherein each flexible tongue includes a metallic core, the metallic core being covered by plastic at least at the opposed end spaced from the section bar.

7. The cushion system according to claim 1, further including a respective second flexible tongue substantially parallel to each said flexible tongue in the absence of compression, each flexible tongue and second flexible tongue both being attached to the section bar at a proximal location.

8. The cushion system according to claim 7, wherein each respective second flexible tongue has a length shorter than a length of each flexible tongue, wherein each flexible tongue is arranged closer to the upright than each respective second flexible tongue, during compression.

9. The cushion system according to claim 7, wherein each flexible tongue is more flexible than each respective second flexible tongue, each flexible tongue and each respective second flexible tongue being separated by a predetermined distance in the absence of compression and being configured to contact to each other during compression.

10. The cushion system according to claim 1, wherein each cushion of the plurality of cushions includes a respective raceway having a substantially C-shaped cross-section to fasten the cushion to an edge of the section bar, wherein the end of each flexible tongue attached to the section bar is also attached to an outer surface of the respective raceway.

11. The cushion system according to claim 1, wherein each flexible tongue is at an acute angle with respect to section bar in the absence of compression.

12. The cushion system according to claim 1, wherein each flexible tongue is curved in the absence of compression.

13. The cushion system according to claim 1, wherein each flexible tongue is elastically deformable.

14. The cushion system according to claim 10, wherein each respective raceway includes a bottom having a predetermined width and two sides convergent from the bottom towards an opening of the substantially C-shaped cross-section, the section bar configured to contact and be disposed between the two sides.

15. The cushion system according to claim 14, wherein at least one of the two sides includes a flange having a tip extending towards the section bar, the tip configured to secure the section bar within the respective raceway.

16. The cushion system according to claim 15, wherein one of the two sides of the respective raceway is substantially perpendicular to the bottom and the other one of the two sides slopes towards the opening of the substantially C-shaped cross-section to reduce the width thereof in the absence of compression.

17. The cushion system according to claim 15, wherein the end of each flexible tongue, which is attached to the respective raceway, is at one end of one side of the raceway that is substantially perpendicular to the bottom.

18. The cushion system according to claim 17, wherein the opposite end of each flexible tongue in the absence of compression is substantially vertically aligned with an opposed end of said one side of the respective raceway that is substantially perpendicular to the bottom.

19. The cushion system according to claim 18, wherein the opposite end of each flexible tongue projects out from the respective raceway in a direction parallel to an axis of the raceway.

20. The cushion system according to claim 1, wherein each flexible tongue is concave with respect to a surface of the section bar.

21. The cushion system according to claim 1, wherein each flexible tongue is convex with respect to a surface of the section bar.

22. The cushion system according to claim 1, wherein each cushion is made of polypropylene.

23. The cushion system according to claim 10, wherein each respective raceway is enbloc with each flexible tongue.

24. The cushion system according to claim 10, wherein each respective raceway has a length of about 2 cm.

25. The cushion system according to claim 10, wherein the section bar includes: a rounded or beveled edge portion that serves as a draft of each respective raceway; and a groove for hooking a tip of a flange of each respective raceway.

* * * * *